US006646531B2

(12) United States Patent
Kim

(10) Patent No.: US 6,646,531 B2
(45) Date of Patent: Nov. 11, 2003

(54) COATED COIL ASSEMBLY OF A TRANSFORMER

(75) Inventor: Cheol-Jin Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/075,313

(22) Filed: Feb. 15, 2002

(65) Prior Publication Data

US 2002/0089403 A1 Jul. 11, 2002

Related U.S. Application Data

(62) Division of application No. 09/616,976, filed on Jul. 14, 2000, now Pat. No. 6,334,972.

(30) Foreign Application Priority Data

Jul. 26, 1999 (KR) ..... 1999-30304

(51) Int. Cl.[7] ..... H01F 27/02

(52) U.S. Cl. ..... 336/90; 336/96; 336/82; 336/83; 336/178

(58) Field of Search ..... 336/90, 96, 82, 336/83, 178, 205, 207, 208, 60, 196; 335/250, 299, 272.19; 264/263

(56) References Cited

U.S. PATENT DOCUMENTS

| | | | | |
|---|---|---|---|---|
| 2,956,312 A | | 10/1960 | Naimer | |
| 3,268,645 A | | 8/1966 | Stampfli | |
| 3,626,051 A | | 12/1971 | Liautaud | |
| 3,774,298 A | * | 11/1973 | Eley | 29/605 |
| 3,811,045 A | | 5/1974 | Turner et al. | |
| 4,337,219 A | | 6/1982 | Falkowski et al. | |
| 4,725,395 A | | 2/1988 | Gasparaitis et al. | |
| 5,317,300 A | | 5/1994 | Boesel | |
| 5,497,136 A | * | 3/1996 | Wall | 335/299 |
| 5,524,334 A | | 6/1996 | Boesel | |
| 5,596,797 A | | 1/1997 | Bumsted | |
| 5,659,246 A | | 8/1997 | Togo et al. | |

FOREIGN PATENT DOCUMENTS

| | | |
|---|---|---|
| DE | 3430586 A1 | 2/1986 |
| DE | 19758213 A1 | 7/1999 |

OTHER PUBLICATIONS

German Patent Office Action and Translation of the Office Action of Jan. 16, 2002 for German Patent Application Serial No. 100 36 062.9–33 of Samsung Electronics Co., Ltd. filed on the 25$^{th}$ of Jul. 2000.

* cited by examiner

*Primary Examiner*—Elvin Enad
*Assistant Examiner*—Jennifer A Poker
(74) *Attorney, Agent, or Firm*—Robert E. Bushnell, Esq.

(57) ABSTRACT

A method for forming a resin molding on a coil of a transformer is disclosed. The method comprises the steps of inserting a coil into an auxiliary spacing apparatus, inserting the auxiliary spacing apparatus into a mold, and forming a resin molding for the auxiliary spacing apparatus with the coil by putting a resin into the mold. According to the methods, the coil is not damaged and a resin molding is formed with a uniform thickness.

27 Claims, 8 Drawing Sheets

COATED COIL ASSEMBLY OF A TRANSFORMER

CROSS-REFERENCE TO RELATED APPLICATIONS

This application is a division of U.S. patent application Ser. No. 09/616,976 filed on Jul. 14, 2000, now U.S. Pat. No. 6,334,972 issued on Jan. 1, 2002.

CLAIM OF PRIORITY

This application makes reference to, incorporates the same herein, and claims all benefits accruing under 35 U.S.C. §119 from an application for Resin Molding Method For A Coil Used In A Transformer Of A Microwave Oven earlier filed in the Korean Industrial Property Office on Jul. 26, 1999 and there duly assigned Serial No. 30304/1999 and was laid open on Feb. 15, 2001.

FIELD OF THE INVENTION

The present invention relates to a transformer, and more particularly to a method for forming a resin molding on a coil of a transformer.

DESCRIPTION OF THE RELATED ART

Generally, since a high voltage is applied to the coil, a coil used in the transformer of a microwave oven is insulated electrically by an insulating paper or a resin molding. FIG. 1 is an analyzed perspective view for illustrating a method for forming a resin molding for a coil for electrically insulating the coil used in the transformer of the microwave oven in the related art. FIG. 2 is a perspective view for showing the coil covered with a resin molding formed by using the method of FIG. 1.

Referring to the resin molding method for the coil used in the transformer, as shown in FIG. 1, the coil 11 is inserted into a cavity 16 of a metal mold, and then a resin is injected to the coil 11 to form a resin molding 21 on the coil 11 as shown in FIG. 2. In FIG. 1, a reference numeral 12 denotes a connector for drawing out terminal ends from the coil 11. The connector 12 may be connected to the coil 11 for drawing out terminal ends from the coil 11 as shown in FIG. 1, or only two pieces of lines may be drawn out from the coil 11, although such is not shown in the drawings.

The resin molding 21 formed on the coil 11 is required to have a uniform thickness for a good insulation. When the thickness of the resin molding 21 is not uniform, the device can be damaged due to an insulation breaking. Therefore, a plurality of spacing projections 17 are formed on the internal walls of the cavity 16 of the metal mold 15 to keep a uniform interval between the coil 11 and the internal wall. The interval between the coil 11 and the internal wall of the cavity 16 of the metal mold 15 is kept uniform due to the spacing projections 17. Therefore, the resin molding 21 can be formed with a uniform thickness on the coil 11.

However, according to the conventional resin molding method for a coil of a transformer in the microwave oven, when the coil is inserted into the cavity 16 of the metal mold 15, the coil 11 can be damaged due to the spacing projections 17 which are projected from the internal wall of the cavity 16. When a transformer with the scraped coil is used for a long time, the damaged part of the coil 11 breaks easily, and accordingly, the transformer goes out of order. Moreover, the resin molding 21 has recesses 22 formed due to the presence of the spacing projections 17. The resin molding 21 at the recesses 22 may be formed with a thin thickness, or may not be formed at all. In the above cases, the coil 11 is easily damaged. When the coil 11 is damaged and exposed, the insulating status of the coil 11 of the transformer is deteriorated, and accordingly, sparks are generated while the transformer is operated. What is needed is a two step molding process where either an auxiliary spacing apparatus made of resin is first formed around the coil before molding or the coil is twice molded, the first time the molded coil has projections and after the second resin molding, the projections of the first molding process are covered up.

SUMMARY OF THE INVENTION

The present invention has been developed to overcome the above problems of the related art, and accordingly it is an object of the present invention to provide a method for forming a resin molding for a coil of a transformer by which the coil is not damaged and the resin molding is formed with an uniform thickness.

The above object is accomplished by a method for forming a resin molding for a coil of a transformer according to the present invention, by inserting a coil into an auxiliary apparatus for spacing; inserting the auxiliary spacing apparatus into a mold; and forming a resin molding for the auxiliary spacing apparatus with the coil by putting a resin into the mold.

The auxiliary spacing apparatus may be formed of the same resin used in the resin molding, or may be a different resin. The auxiliary spacing apparatus has a mesh shape so that the resin used in the resin molding makes enough contact with the coil.

The auxiliary spacing apparatus has preferably a plurality of projections formed on an external surface thereof for ensuring a thickness sufficient to electrically insulate the coil and emit the heat of the coil. Meanwhile, the coil can be directly wounded around the auxiliary spacing apparatus.

The above object is also accomplished by another method for forming a resin molding for a coil of the transformer according to the present invention, by inserting a coil into a primary mold to form a spacing part on the coil; inserting the coil with the spacing part into a secondary mold; and forming a resin molding for the coil with the spacing part by putting a resin into the secondary mold.

The spacing part may be formed of the same resin used in the resin molding or may be different resin. The spacing part has projections with multiple stairs formed on the external surface thereof for preventing from being detached from the resin molding by the secondary mold.

BRIEF DESCRIPTION OF THE DRAWING

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREPARED EMBODIMENTS

Figure 1:
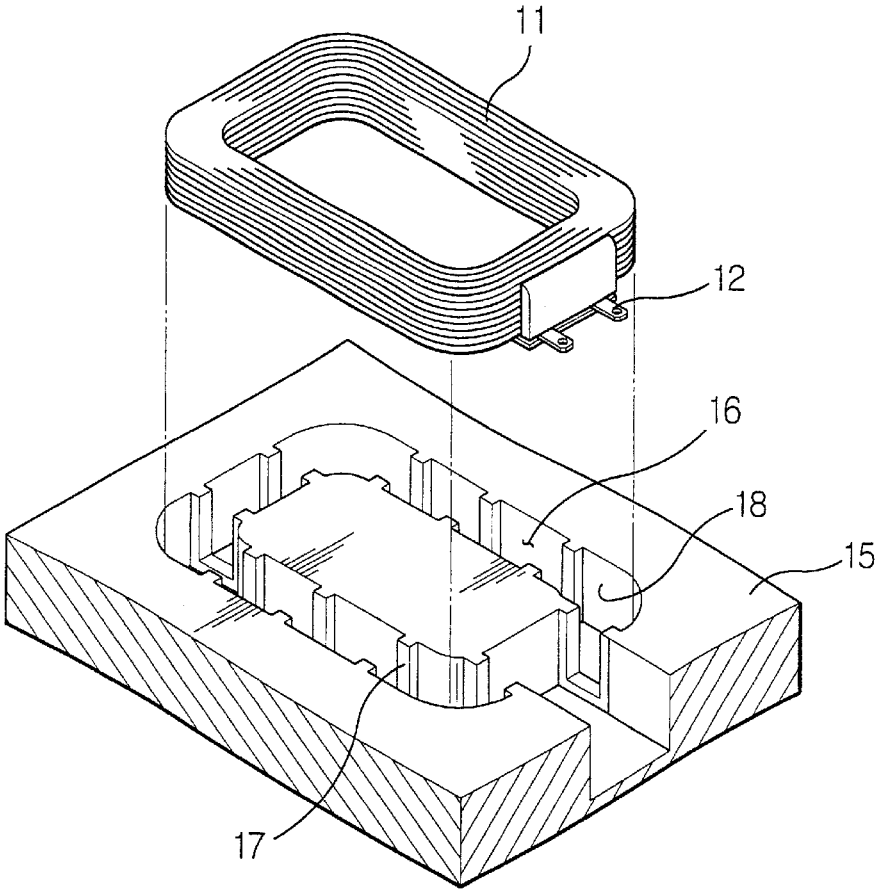
FIG. 1 is an exploded perspective view illustrating a method for forming a resin molding for a coil of the transformer in the related art.
Figure 2:
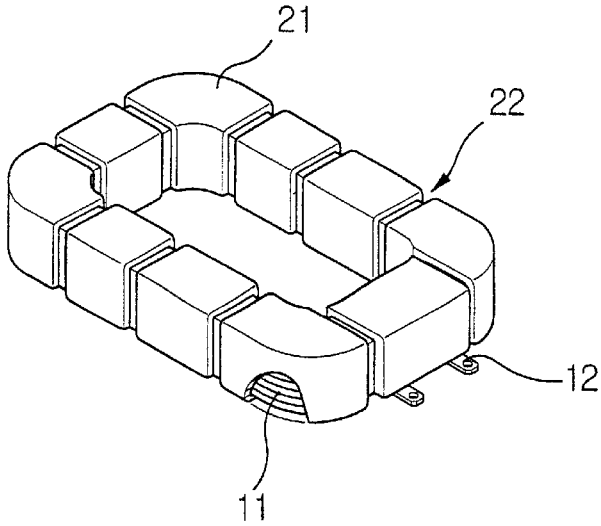
FIG. 2 is a perspective view showing the coil covered with a resin molding formed by using the method of FIG. 1.
Figure 3:
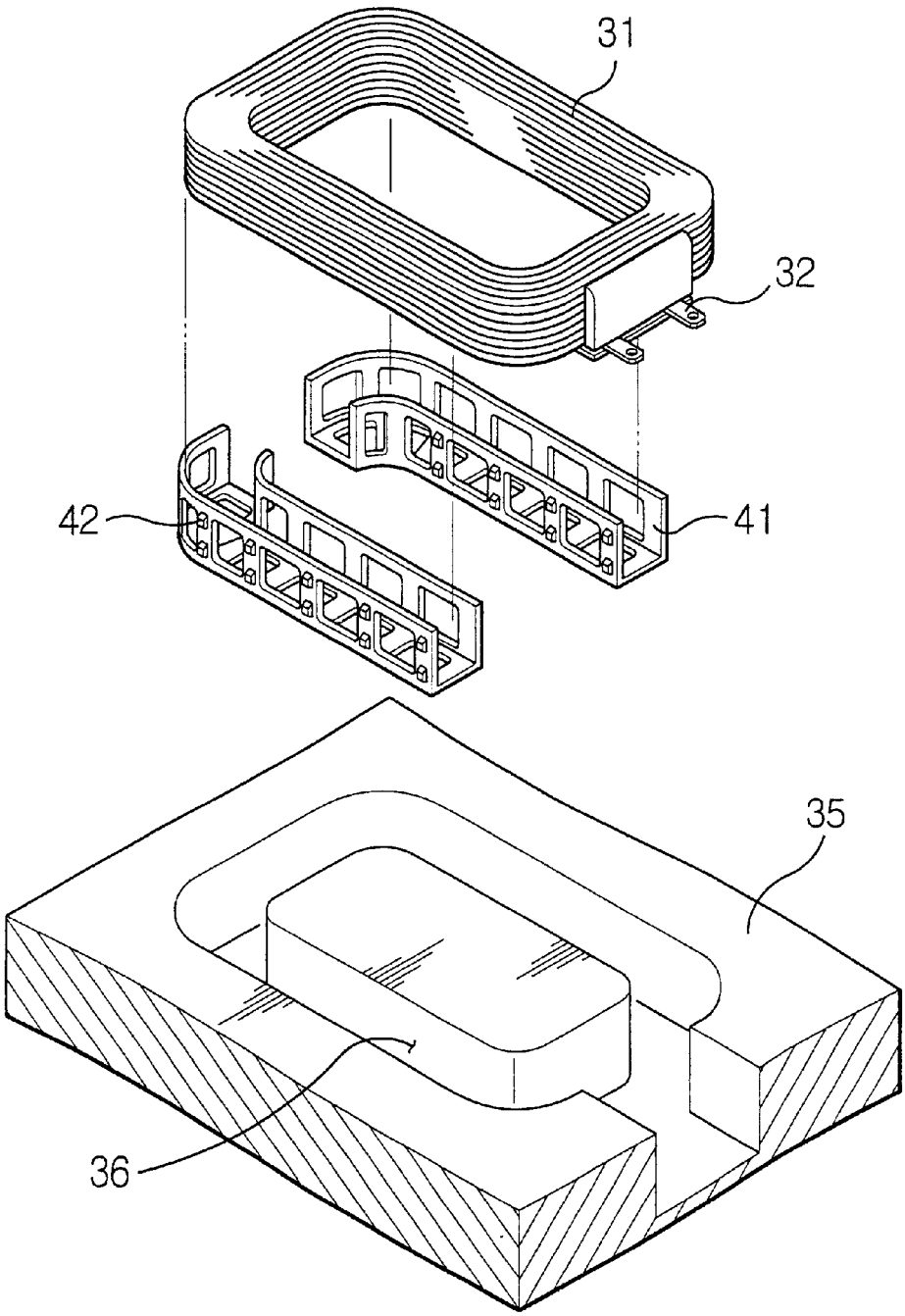
FIG. 3 is an exploded perspective view illustrating a method forming a resin molding for a coil of the transformer according to a first preferred embodiment of the present invention.
Figure 4:
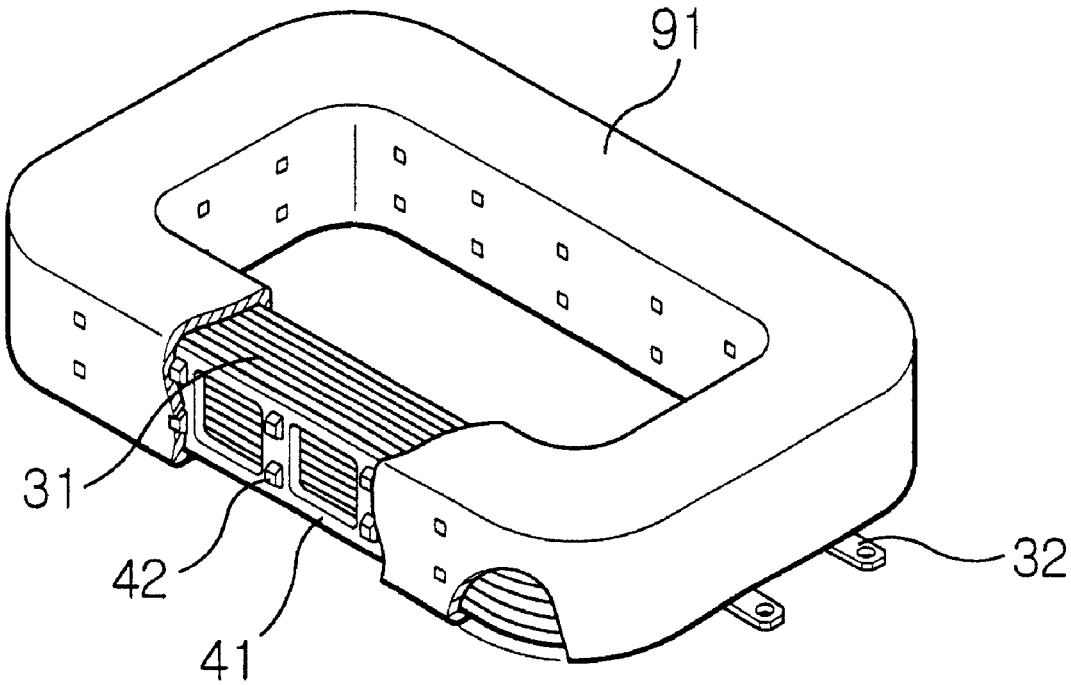
FIG. 4 is a perspective view showing the coil covered with the resin molding formed by the method of FIG. 3.

A first preferred embodiment of the present invention will be described with FIG. 3 and FIG. 4. FIG. 3 is an analyzed perspective view for illustrating a method for forming a resin molding for a coil of the transformer according to a first preferred embodiment of the present invention. Referring to FIG. 3, a coil 31 is inserted into an auxiliary spacing apparatus 41 which is formed with a pair of sub-parts. The auxiliary spacing apparatus 41 with the coil 31 is inserted into a cavity 36 of a mold 35, and then a resin molding 91 is formed on the auxiliary spacing apparatus 41 with the coil 31 by putting a resin into the mold 35.

The auxiliary spacing apparatus 41 may be formed of the same resin used in the resin molding or may be formed of a different resin. The auxiliary spacing apparatus 41 has a mesh shape so that the resin used in the resin molding makes sufficient contact with the coil 31. The auxiliary spacing apparatus 41 has preferably a plurality of projections 42 on an external surface thereof for preventing the coil 31 from leaning to one side in the cavity 36 of the metal mold 35 and for ensuring an enough thickness to electrically insulate the coil 31 and to emit heat of the coil 31.

The projections 42 have edges of which ends are cut off or rounded off so that the auxiliary apparatus for spacing 41 can be inserted easily into the cavity 36 of the metal mold 35. Furthermore, the opening part of the auxiliary spacing apparatus 41 has edges of which ends are cut off or rounded off so that the coil 31 can be inserted easily into the auxiliary apparatus for spacing 41. A reference numeral 32 denotes connector for drawing out terminal ends from the coil 31. The connector 32 can be connected to the coil 11 for drawing out terminal ends from the coil 31 as shown in FIG. 3, or only two pieces of lines can be drawn out from the coil 31, which are not shown in the drawings. According to the method for forming the resin molding for the coil of the transformer of the first embodiment of the invention, the coil 31 is inserted into the cavity 36 of the metal mold 35 as the coil 31 is put in the auxiliary spacing apparatus 41 formed of resin, and thereby the coil 31 cannot be damaged when the coil 31 is inserted into the cavity 35. Furthermore, according to the method for forming the resin molding for the coil of the transformer, as shown in FIG. 4, the resin molding 91 has no recesses formed on the external surface thereof, and thereby the resin molding 91 with a uniform thickness can be obtained. When the auxiliary spacing apparatus 41 is formed of the same resin as that used for the resin molding, the auxiliary spacing apparatus 41 cannot be damaged and cannot be broken in insulation before the resin molding 91. Moreover, since the material interposed between the coil 31 and the resin molding 91 is the same resin as that used for the resin molding, the thermal conductivity decrease is prevented.

Figure 5:
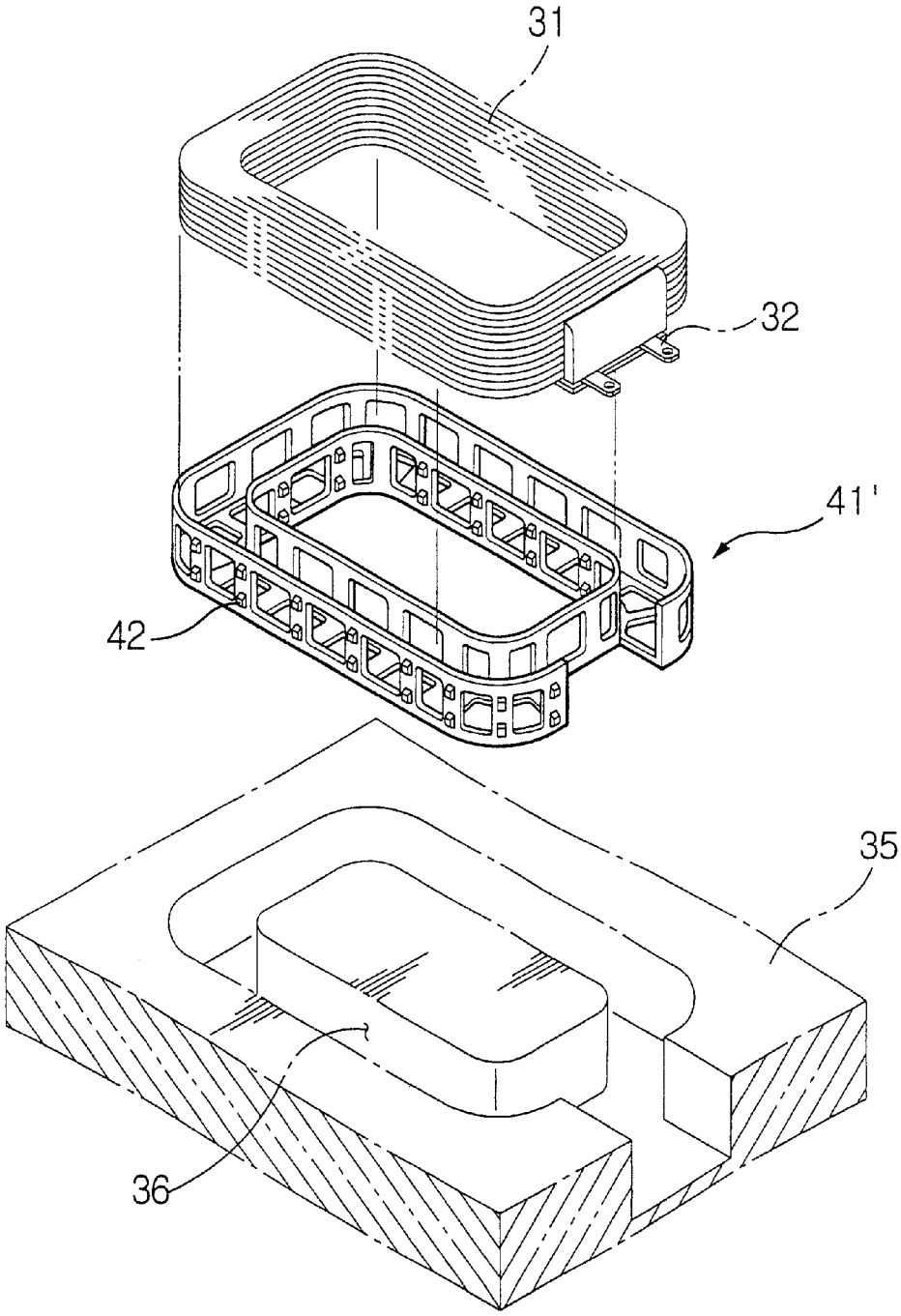
FIG. 5 is a perspective view showing another auxiliary spacing apparatus used in a method for forming a resin molding for a coil according to a second preferred embodiment of the present invention, in which the auxiliary spacing apparatus is different from that used in FIG. 3.

Meanwhile, the second preferred embodiment of the present invention will be described with FIG. 5. Another auxiliary spacing apparatus 41' used in the method for forming the resin molding for the coil according to the second preferred embodiment of the present invention is shown in FIG. 5. The auxiliary spacing apparatus 41' of FIG. 5 is equivalent to that of FIG. 3 except that it is composed of one body while the auxiliary spacing apparatus 41 is composed of two bodies.

Figure 6:
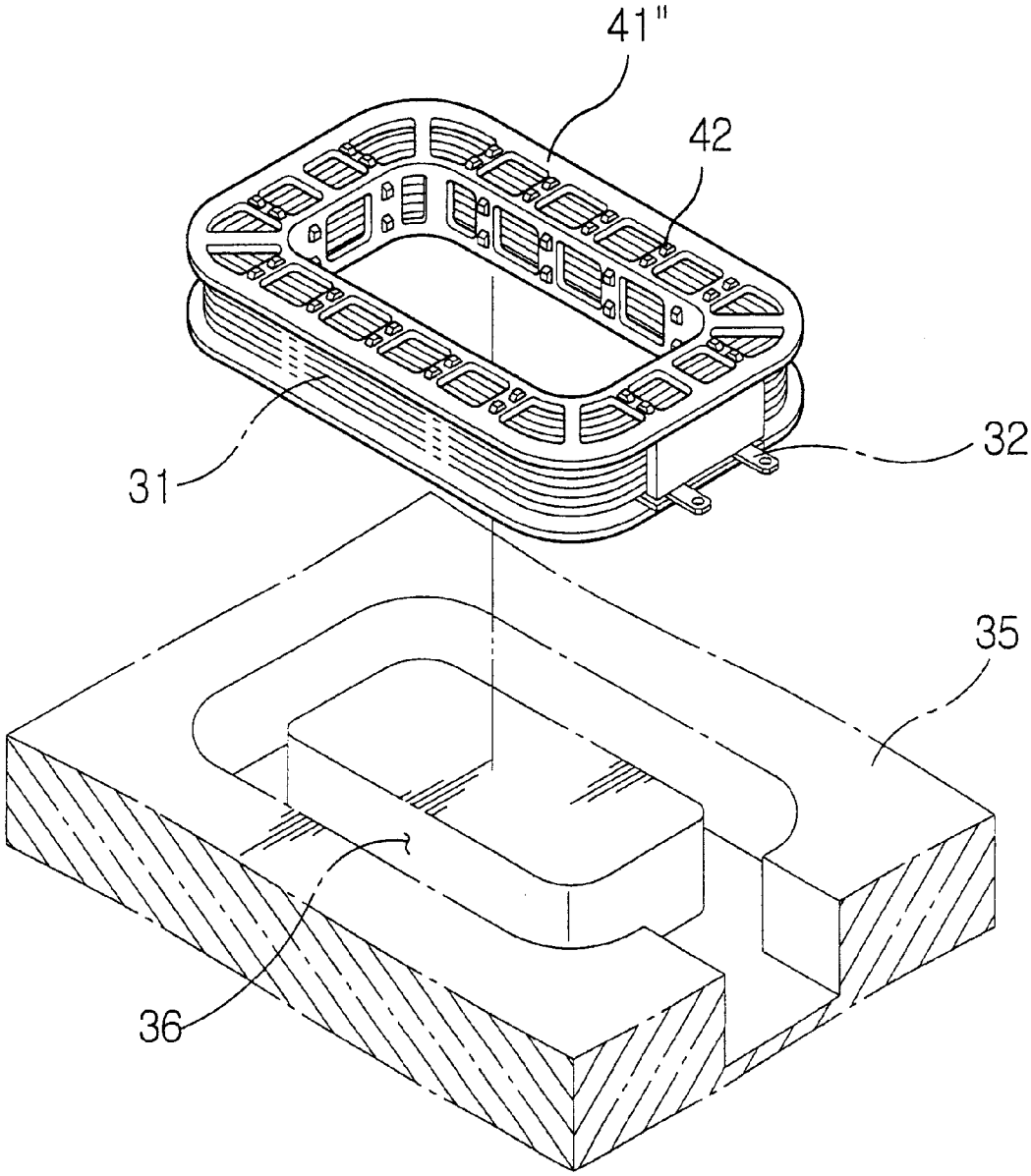
FIG. 6 is a perspective view showing another auxiliary spacing apparatus used in a method for forming a resin molding for a foil according to a third preferred embodiment of the present invention, in which the auxiliary spacing apparatus is different from that used in FIG. 3 or FIG. 5.
Figure 7:
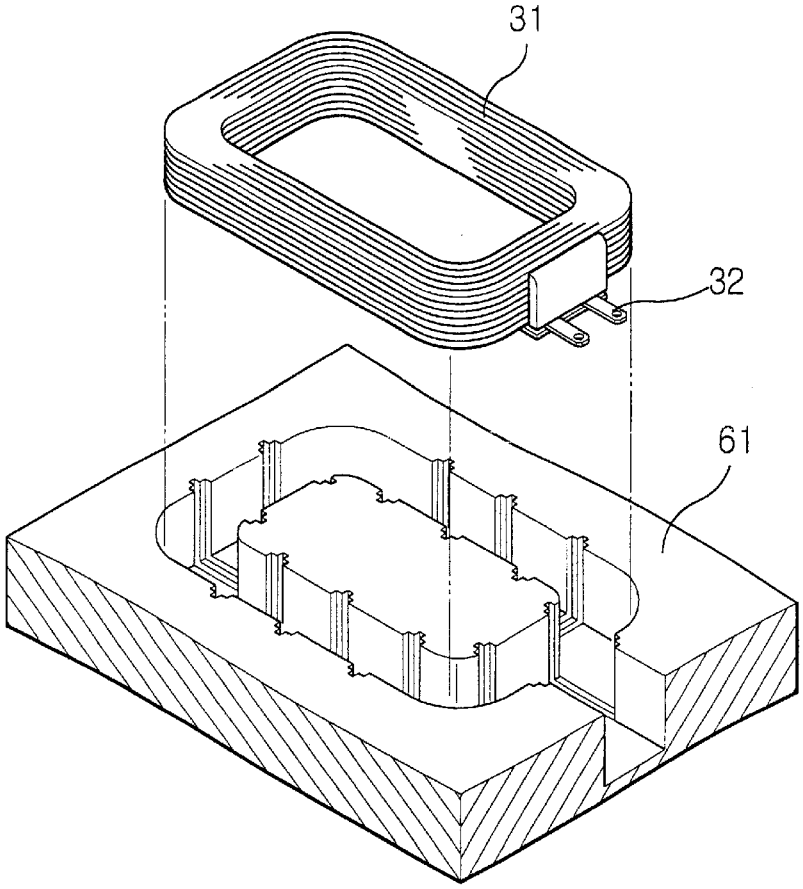
FIG. 7 is an analyzed perspective view illustrating a step for inserting a coil into a primary mold in a method for forming a resin molding for a coil of a transformer according to a fourth preferred embodiment of the present invention.
Figure 8:
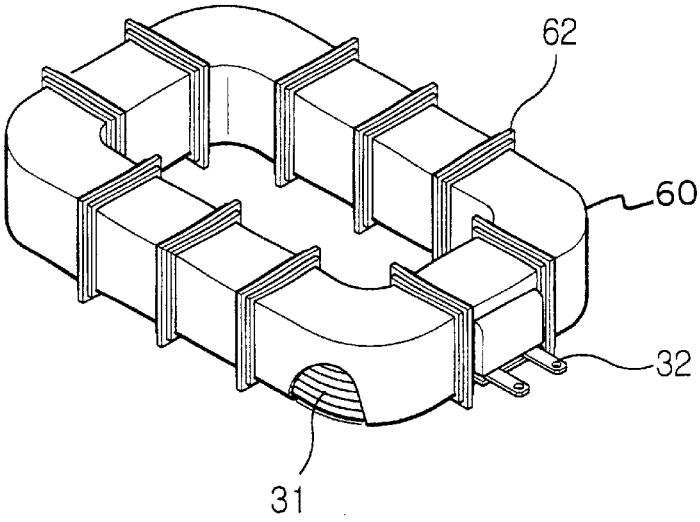
FIG. 8 is a perspective view showing a spacing part with a coil formed by the method for forming the resin molding for the coil according to the fourth preferred embodiment of the present invention.
Figure 9:
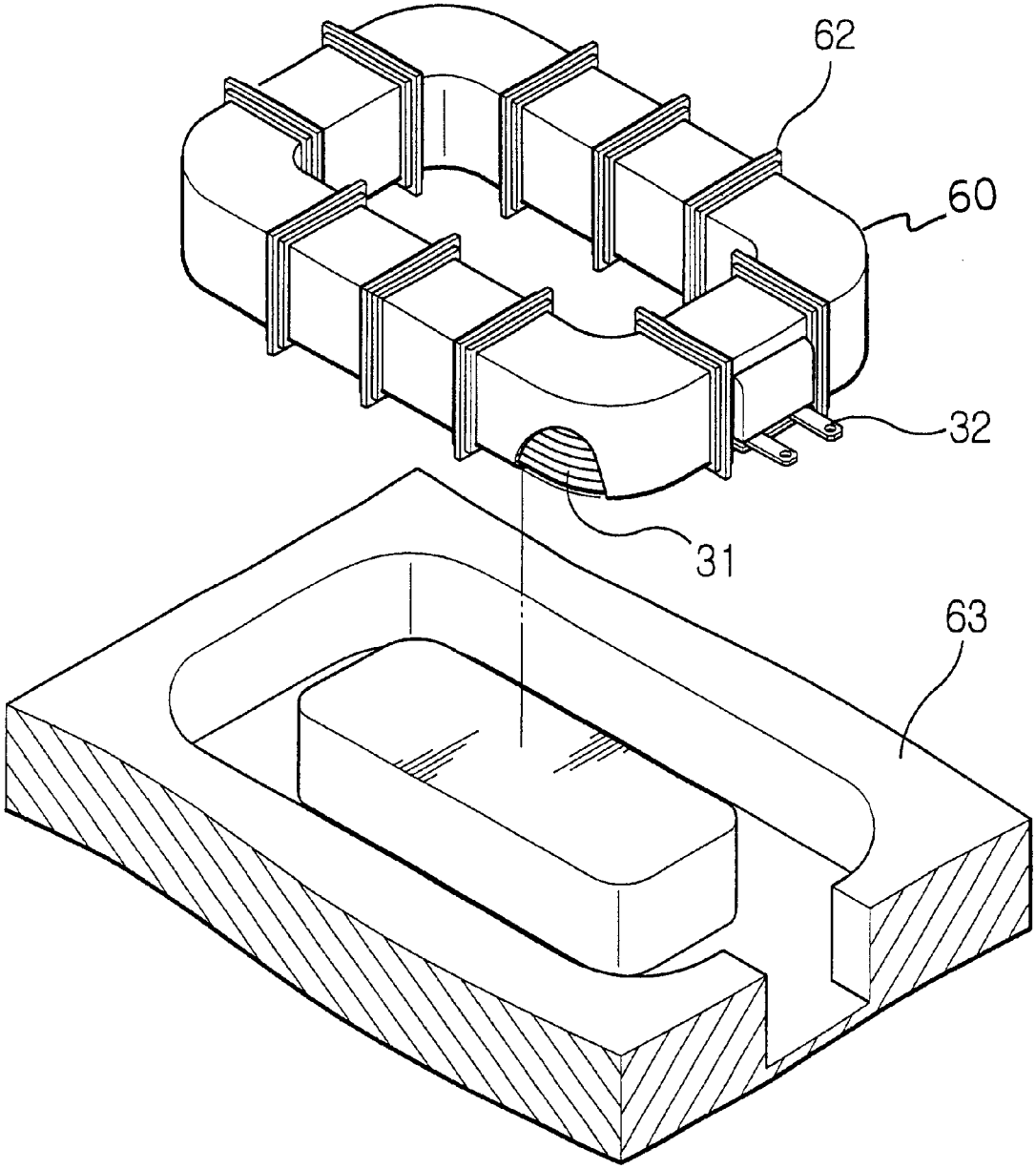
FIG. 9 is an analyzed perspective view illustrating a step for inserting the spacing part with the coil into a secondary mold in the method for forming the resin molding on the spacing part with the coil according to the fourth preferred embodiment of the present invention.

The third preferred embodiment of the present invention will be described with FIG. 6. Another auxiliary spacing apparatus 41" used in the method for forming the resin molding for the coil according to the third preferred embodiment of the present invention is shown in FIG. 6. The auxiliary spacing apparatus 41" of FIG. 6 is equivalent to that of FIG. 5 except that the coil 31 which has been previously wound, is inserted into the auxiliary spacing apparatus 41' in FIG. 5, while the coil 31 is wound directly around the auxiliary spacing apparatus 41' in FIG. 6.

The fourth preferred embodiment of the present invention will be described with FIG. 7 to FIG. 10. The coil 31 is inserted into a primary mold 61 (refer to FIG. 7) to form a spacing part 60 on the coil 31 (refer to FIG. 8). The coil 31 with the spacing part 60 is inserted into a secondary mold 63, and then a resin molding 91 is formed for the coil 31 with the spacing part 60 by putting a resin into the secondary mold 63. The spacing part 60 may be formed of the same resin used in the resin molding, or may be formed of a different resin. The spacing part 60 has projections 62 with multiple steps formed on the external surface that are preventing from being detached from resin molding 91. A reference numeral 32 denotes a connector for drawing out terminal ends from the coil 31. The connector 32 can be connected to the coil 31 for drawing out terminal ends from the coil 31 as shown in FIG. 3, or only two pieces of lines can be drawn out from the coil 31, although the same are not shown in the drawings.

Figure 10:
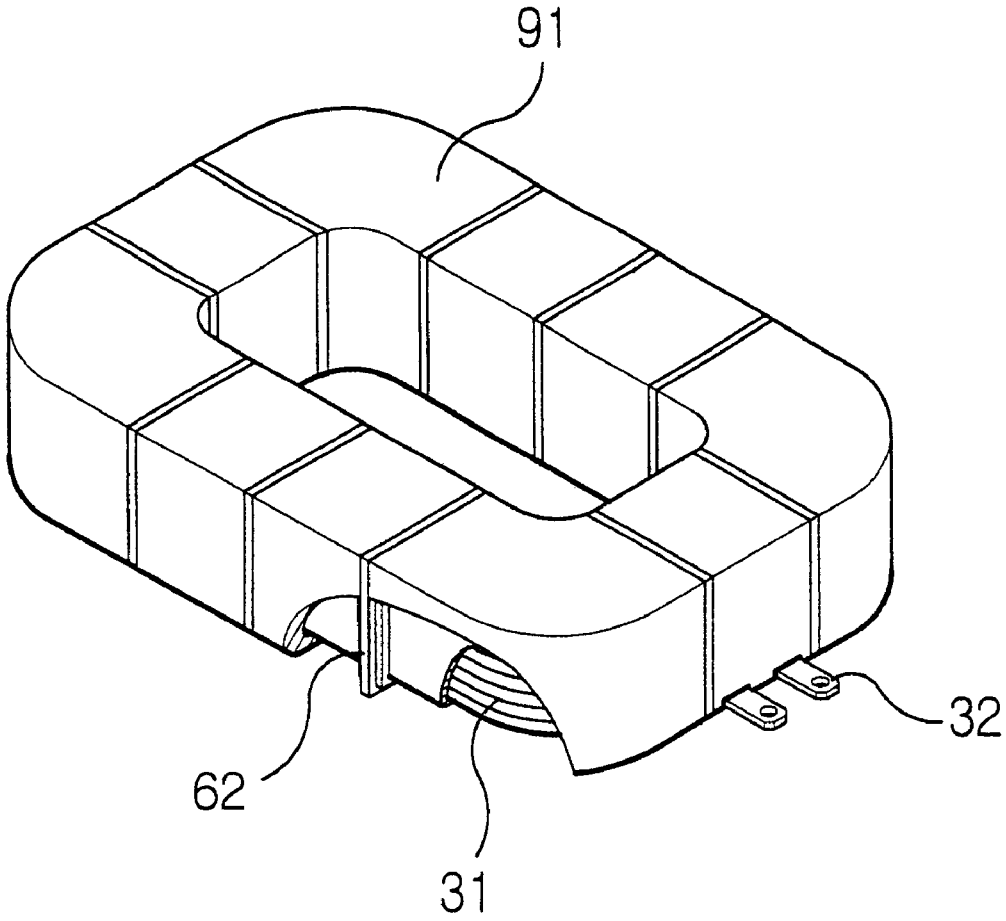
FIG. 10 is a perspective view showing the coil covered with the final resin molding formed by the method for forming the resin molding for the coil according to the fourth preferred embodiment of the present invention.

According to the method for forming the resin molding for the coil of the transformer of the fourth embodiment of the invention, the coil 31 is inserted into the cavity of the metal mold 61 or 63 in which the metal molds 61 and 63 have no projections on their internal walls, and thereby the coil 31 cannot be damaged when the coil 31 is inserted into the cavity of the metal mold 61 or 63. Furthermore, according to the method for forming the resin molding for the coil of the transformer of the fourth embodiment of the invention, as shown in FIG. 10, the resin molding 91 has no recesses formed on the external surface thereof, and thereby the resin molding 91 with a uniform thickness can be obtained.

When the spacing part 60 is formed of the same resin as that used for the resin molding 91, the spacing part 60 cannot be damaged and cannot be broken in insulation before the resin molding 91. Moreover, since the material interposed between the coil 31 and the resin molding 91 is the same resin as that used for the resin molding, the thermal conductivity decrease is prevented. Therefore, according to the methods for forming the resin molding for the coil of the transformer of the embodiments of the invention, the coil is not damaged and a resin molding is formed with an uniform thickness.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A coated coil assembly, comprising:

an auxiliary spacing apparatus comprising:

a portion defining a space for receiving a wound coil therein, and a plurality of protrusions contacting a mold when the wound coil is received into the mold, the protrusions maintaining a predetermined gap between the coil and the mold, whereby a resin layer is formed on the coil; and said resin layer enclosing the auxiliary spacing apparatus and with the coil received in the auxiliary spacing apparatus, and protecting the coil mechanically and electrically.

2. The coated coil assembly of claim 1, with said auxiliary spacing apparatus and said resin layer comprising a same composition of resin.

3. A coated coil assembly, comprising:

an auxiliary spacing apparatus comprising:

a plurality of continuous walls defining a cavity accommodating reception of a plurality of windings of an electrical coil; and a plurality of discrete spacers protruding spaced-apart along a multiplicity of outer surfaces of said walls opposite from said cavity, said spacers extending outwardly from said surfaces; and a layer of resin encasing said auxiliary spacing apparatus and a coil located within said cavity.

4. The coated coil assembly of claim 3, with said spacers, said auxiliary spacing apparatus and said layer of resin comprising a same composition of resin.

5. The assembly of claim 1, with said auxiliary spacing apparatus comprising two "J" shaped receptors to receive said coil.

6. The assembly of claim 1, said coil being inserted into said space of said auxiliary spacing apparatus only by being wound around said auxiliary spacing apparatus, said coil not being able to slip on to said auxiliary spacing apparatus.

7. The assembly of claim 1, with said auxiliary spacing apparatus being a single integrated monolithic unit having an oval shape accommodating insertion of said coil.

8. The assembly of claim 3, with said auxiliary spacing apparatus comprising two "J" shaped receptors surrounding said coil.

9. The assembly of claim 3, said coil being inserted into said space of said auxiliary spacing apparatus only by being wound around said auxiliary spacing apparatus, said coil not being able to slip on to said auxiliary spacing apparatus.

10. The assembly of claim 3, with said auxiliary spacing apparatus comprising a single integrated monolithic unit having an oval shape and capable of having a previously wound coil within.

11. The assembly of claim 3, each wall of said auxiliary spacing apparatus having said discrete spacers protruding therefrom.

12. The assembly of claim 3, said layer of resin being in solid form.

13. A coated coil assembly, comprising:

a first metal mold, said first metal mold having a first cut-out for receiving a previously wound coil, said first cut out of said first metal mold having recesses throughout said first cutout;

a second metal mold having a second cutout slightly larger than said first cutout, said second cutout being absent recesses or projections;

a coil comprising a plurality of electrically conductive windings; and resin that is applied when said coil is placed in said first metal mold to fill spaces comprising said recesses between said coil and said first metal mold, said resin also being applied to said coil coated with resin having protrusions produced by said recesses of said first metal mold when placed in said second metal mold.

14. The assembly of claim 13, wherein said resin is an electrically insulating material.

15. The assembly of claim 13, said first and said second metal molds have an opening for accommodating electrical leads of said coil.

16. The assembly of claim 13, said resin having a uniform thickness at all portions of said coil except for electrical leads of said coil after resin is injected into said second metal mold containing said coil coated by resin when placed in said first metal mold.

17. A coated coil assembly, comprising:

a coil of an electrical conductor, said coil having an upper surface, a lower surface, an inner surface and an outer surface;

a receptacle having three walls connected to each other and forming a space wherein said coil resides in said space of said receptacle, each of said three walls of said receptacle having a plurality of discrete protrusions spaced-apart along and extending outwardly from each of said three walls, said projections being disposed only on sides of said three walls opposite said space where said coil resides; and a resin layer encasing said coil and said three walls of said receptacle and said projections of said receptacle.

18. The assembly of claim 17, said resin layer and said receptacle being comprised of a same composition of resin.

19. The assembly of claim 17, said assembly further comprising a plurality of electrical leads terminating said coil and exposed through said resin layer.

20. The assembly of claim 17, each of said three walls of said receptacle being mesh and having openings therein.

21. The assembly of claim 17, said three walls of said receptacle covering said bottom surface, said inner surface and said outer surface of said coil, said upper surface of said coil not being covered by said receptacle, said coil capable of being inserted into said receptacle.

22. The assembly of claim 17, said three walls of said receptacle covering said bottom surface, said top surface and said inner surface, said outer surface of said coil not being covered by a wall of said receptacle, said coil not being able to be inserted into said receptacle, said coil capable of being wound around said receptacle.

23. The assembly of claim 17, with said receptacles comprising two "J" shaped receptors.

24. A coated coil assembly, comprising:

a coil comprising a plurality of electrically conductive windings;

spaces comprising a layer of resin encasing said coil and a plurality of discrete ridges of said resin, spaced-apart along and extending outwardly from said resin; and a coating of resin disposed between said ridges and covering said layer of resin.

25. The assembly of claim 24, said resin being an electrically insulating material.

26. The assembly of claim 24, comprising a plurality of electrical leads of said coil, exposed by said resin layer.

27. The assembly of claim 24, said resin having a uniform thickness at all portions of said coil except for electrical leads terminating said coil, after said coil is coated by said coating of resin.

* * * * *